US008316918B2

(12) United States Patent
Hadano et al.

(10) Patent No.: US 8,316,918 B2
(45) Date of Patent: Nov. 27, 2012

(54) FLASKLESS MOLDING MACHINE

(75) Inventors: Yutaka Hadano, Toyokawa (JP); Takayuki Komiyama, Toyokawa (JP); Shuji Takasu, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/203,955

(22) PCT Filed: Mar. 31, 2010

(86) PCT No.: PCT/JP2010/055875

§ 371 (c)(1),
(2), (4) Date: Aug. 30, 2011

(87) PCT Pub. No.: WO2011/086712

PCT Pub. Date: Jul. 21, 2011

(65) Prior Publication Data

US 2011/0308756 A1 Dec. 22, 2011

(30) Foreign Application Priority Data

Jan. 15, 2010 (JP) ..... 2010-006368

(51) Int. Cl.
*B22C 15/24* (2006.01)
*B22C 15/28* (2006.01)

(52) U.S. Cl. ..... 164/200; 164/37; 164/172; 164/194; 164/195; 164/201; 164/202

(58) Field of Classification Search ..... 164/20, 164/23, 37, 169, 172, 194, 195, 200–202
See application file for complete search history.

(56) References Cited

U.S. PATENT DOCUMENTS

| | | | | |
|---|---|---|---|---|
| 4,262,731 | A * | 4/1981 | Wetzel | 164/19 |
| 5,785,111 | A * | 7/1998 | Noguchi et al. | 164/200 |
| 2004/0060686 | A1 | 4/2004 | Sorensen | |

FOREIGN PATENT DOCUMENTS

| | | | |
|---|---|---|---|
| CN | 101578147 | A | 11/2009 |
| JP | 59-24552 | | 2/1984 |
| JP | 2002361368 | A * | 12/2002 |
| JP | 2004-517735 | A | 6/2004 |
| JP | 2005-262254 | | 9/2005 |
| JP | 2008-213036 | A | 9/2008 |
| JP | 4341021 | | 7/2009 |
| WO | WO 02/062507 | A1 | 8/2002 |

OTHER PUBLICATIONS

International Search Report dated Apr. 27, 2010 issued in International Application No. PCT/JP2010/055875.

* cited by examiner

*Primary Examiner* — Kuang Lin
*Assistant Examiner* — Kevin E Yoon
(74) *Attorney, Agent, or Firm* — Finnegan, Henderson, Farabow, Garrett & Dunner, L.L.P.

(57) ABSTRACT

The present invention provides a flaskless molding machine that can use a matching plate of different thicknesses. The flaskless molding machine has two molding flasks that have a matching plate sandwiched between them, the two molding flasks being positioned in a way such that one of opening ends of the molding flasks is opposed to each other and each of the other opening ends of the molding flasks is engaged with a squeezing board, and a pair of spaces is formed, into which spaces molding sand is filled by air through each of the openings for introducing the molding sand, disposed on a wall of each of the two molding flasks that are opposed to each other, the flaskless molding machine thus constituted being able to mold two molds by squeezing the molding sand with the squeezing boards.

9 Claims, 5 Drawing Sheets

FLASKLESS MOLDING MACHINE

FIELD OF INVENTION

This invention relates to a flaskless molding machine. More particularly it relates to a flaskless molding machine that can simultaneously mold a flaskless upper mold and a flaskless lower mold, i.e., the upper mold and the lower mold that are ejected from flasks and that can use not only a normal matching plate but also a pattern plate that is reused as a matching plate.

BACKGROUND OF THE INVENTION

The flaskless molding machine that uses a matching plate is known, wherein so as to reuse a pattern plate, the matching plate having a plate-like member is manufactured by putting together the back surface of the pattern plate having a pattern only on one side and specifically used for an upper molding flask and the back surface of the pattern plate having a pattern only on one side and specifically used for a lower molding flask (See, for example, Patent Document 1).

The flaskless molding machine of Patent Document 1 has two molding flasks that have a matching plate sandwiched between them, the two molding flasks being placed in a way such that each one of the opening ends of each molding flask is opposed to each other and each of the other opening ends of each molding flask is engaged with a squeezing plate (board), whereby a pair of molding spaces is formed, each space being a space to produce a mold, into which spaces the molding sand is filled by air through the openings for sand-feed. Each of the openings is disposed on a wall of each of the two molding flasks that form the pair of molding spaces and that are placed in positions opposed to each other, as described above. The flaskless molding machine thus constituted is able to mold two molds by squeezing the molding sand with the squeezing plates (boards), wherein such flaskless molding machine comprises a driving means that moves at least one of the molding flasks, depending on the thickness of the matching plate, and a driving means that moves at least one of the hoppers or hopper-nozzles, while it moves the positions of the openings for sand-feed disposed on the walls of molding flasks, so that the positions of the hoppers or hopper-nozzles matches the those of the openings for sand-feed.

However, the flaskless molding machine of Patent Document 1 must additionally include large-sized components, such as a cylinder, a member for positioning, parts for the driving means, etc., that move a tank that supplies the sand. Also, as the flaskless molding machine needs two tanks, it will increases the cost for the tanks and their required attachments, compared with a flaskless molding machine that uses only one tank. Further, if a driving means is added, it disadvantageously makes the structure of flaskless molding machine complex.

PRIOR ART DOCUMENT

Patent Document

Patent document 1: Japanese Patent No. 4341021

SUMMARY OF THE INVENTION

Problem to be Solved by the Invention

To solve the above problem the present invention provides a flaskless molding machine that can use not only a matching plate that can be used for simultaneous molding of an upper mold and a lower mold but also a pattern plate that can be reused as a matching plate whether its width is thin or thick. Thus the flaskless molding machine has a simple structure and does not require any additional means for molding.

Means to Solve the Problem

In order to achieve the above objective, the flaskless molding machine of the present invention has two molding flasks that have a matching plate sandwiched between them, the two molding flasks being positioned in a way such that one of opening ends of the molding flasks is opposed to each other and each of the other opening ends of the molding flasks is engaged with a squeezing board, whereby a pair of spaces is formed, each space being a space to produce a mold (hereafter "molding space"), into which spaces molding sand is filled by air through each of the openings for introducing the molding sand, disposed on a wall of each of the two molding flasks that are opposed to each other, as described above, the flaskless molding machine thus constituted being able to mold two molds by squeezing the molding sand with the squeezing boards, wherein the molding flasks consist of an upper molding flask, a lower molding flask, and a lower filling frame, and wherein the openings for introducing the molding sand are disposed on the side walls of the upper molding flask and the lower filling frame.

Effects of the Invention

In one embodiment the flaskless molding machine of the present invention has openings for introducing the molding sand, each disposed on a side wall of each of the upper molding flask and the lower filling frame.

So, even if the matching plate is thick, the positions of the openings for introducing the molding sand can be moved, depending on the thickness of the matching plate, (FIG. 1). Thus, the flaskless molding machine of the present invention has a simple structure and can use a plate-like matching plate having a thickness of 8 mm or more and 40 mm or less, just as with a pattern plate that is reused.

In another embodiment, also, the flaskless molding machine of the present invention, where the molding flasks consist of an upper molding flask, an upper filling frame, and a lower molding flask, can have the openings for introducing the molding sand, disposed on the side walls of the upper filling frame and the lower molding flask (FIG. 2). The flaskless molding machine of the present invention has the openings for introducing the molding sand, disposed on the side walls of the upper filling frame and the lower molding flask, such that the positions of the openings for introducing the molding sand, disposed on the side walls of the upper filling frame and the lower molding flask can be moved, depending on the thickness of the matching plate, even if the matching plate is thick. Thus even if a plate-like matching plate has a thickness of 8 mm or more and 40 mm or less, like a matching plate that is a reused pattern plate, the flaskless molding machine of the present invention that uses such matching plate can have a simple structure.

In yet another embodiment, also, the flaskless molding machine of the present invention, where the molding flasks consist of an upper molding flask, an upper filling frame, a lower molding flask and a lower filling frame, can have openings for introducing the molding sand, disposed on the side walls of the upper filling frame and the lower filling frame (FIG. 3). The flaskless molding machine of the present invention has openings for introducing the molding sand, disposed on the side walls of the upper filling frame and the lower filling frame such that the positions of the openings for introducing the molding sand, disposed on the side walls of the upper filling frame and the lower filling frame can be moved depending on the thickness of the matching plate even if the matching plate is thick. Thus even if a plate-like a matching plate has a thickness of 8 mm or more and 40 mm or less, like matching plate that is a reused pattern plate, the flaskless molding machine of the present invention that uses such a matching plate can have a simple structure.

In a further embodiment, the flaskless molding machine of the present invention is so constituted that at least one of the upper filling frame and the lower filling frame has a member for introducing the molding sand, the member having an opening for introducing the molding sand and being changeable (the part with a hatching in FIGS. 1-3). Thus a tank that supplies the molding sand (hereafter, "sand-tank") needs no additional parts or components. Moreover, as a conventional member for introducing the molding sand can be used, the flaskless molding machine of the present invention does not require an additional cost for remodeling.

Further, the flaskless molding machine of the present invention is so constituted that at least one of the upper filling frame and the lower filling frame has a member for introducing the molding sand, which member has an opening for introducing the molding sand, wherein the position of the opening for introducing the molding sand relative to the parting plane, which is the plane formed by the upper and lower molds where they contact each other, can preferably be changed, depending on the direction in which the member for introducing the molding sand is fixed. Also, the flaskless molding machine of the present invention has an advantage in that, although fixing the member for introducing the molding sand to the filling frame is required, so as to suitably introduce the molding sand depending on the thickness of the matching plate, this can easily be carried out just by turning the member for introducing the molding sand by 180 degrees. Thus, the operator can readily carry out replacing the components of the flaskless molding machine. Moreover, for the flaskless molding machine of the present invention, a driving means that is used for a conventional sand-tank that requires maintenance work is not needed. Thus, only the consumables parts have to be changed.

To have the direction of the member for introducing the molding sand turn by 180 degrees, the member for introducing the molding sand preferably consists of a main body and a flange, where the flange has fastening holes at four positions that are symmetrically laid out in a left-to-right direction (and in an upper-to-lower direction).

The flaskless molding machine of the present invention can comprise (1) a sand-tank that supplies molding sand into each of a pair of spaces, each space to produce a mold, the sand-tank of which the position is fixed and which has bi-forked protrusions that each have an opening for supplying the molding sand at the ends of the protrusions and (2) a driving means that moves at least one of the lower filling frame or the upper filling frame so as to have the openings for introducing the molding sand of the members for introducing the molding sand match the openings for supplying the molding sand of the sand-tank.

If the sand-tank is fixed, the heavy equipment rarely needs to be moved. So, there is an advantage in that a structure that has a robust frame to support the movement of the heavy equipment is not necessary. If the sand-tank is fixed, preferably only the lower filling frame has a member for introducing the molding sand, which member has an opening for introducing the molding sand and preferably the position of the opening for introducing the molding sand is so designed that its position relative to the parting plane, can be changed depending on the direction of the member for introducing the molding sand that is to be attached. This is because to change the direction of the member for introducing the molding sand would require the parts that enable the change of the direction.

In another embodiment, the matching plate of the present invention can have a plate-like member that is formed by the back surfaces of the two pattern plates put together, one prepared specifically for an upper molding flask having a pattern only on one surface and the other prepared specifically for a lower molding flask having a pattern only on one surface. The matching plate thus prepared has the advantage as described above, even if the thickness of the matching plate varies. Needless to say, the matching plate that is manufactured to simultaneously produce the upper and the lower molds and that has patterns on both the upper and lower surfaces of the plate-like member can be used.

In one embodiment, the flaskless molding machine of the present invention is designed in such a way that the lower molding flask has a matching plate attached to it and the lower molding flask and the matching plate attached to the lower molding flask can enter and exit from the space midway between the upper molding flask and the lower filling frame. In this way the matching plate and the lower molding flask can simultaneously be moved to the position where the molding is carried out. So, the number of driving means can be reduced.

Squeezing boards can comprise a lower squeezing board that can move up and down and an upper squeezing board that is fixed at a position that is above and opposed to the lower squeezing board. Thus the flaskless molding machine of the present invention can introduce the molding sand and carry out the molding by the upward and downward movements of the lower squeezing board. Thus the number of the driving means can be reduced.

Also, the lower filling frame can move up and down independently of and simultaneously with the lower squeezing board, thereby introducing and then squeezing the molding sand carried out by the upward and downward movements of the lower squeezing board and the lower filling frame. So, the flaskless molding machine of the present invention has an advantage in that the upper squeezing board need not be moved upward or downward when forming the molding spaces.

The flaskless molding machine of the present invention preferably has a length of the lower filling frame in the direction of the height of the mold, which length is greater than the length of the lower molding flask in the direction of the height of the mold. This is because if the length of the lower molding flask in the direction of the height of the mold were greater than the length of the lower filling frame in the direction of the height of the mold, the mold that is squeezed would have a length in the direction of the height of the mold where a part of the length, which part contacts the lower molding flask, would be greater than a part of the length, which part contacts the lower filling frame.

If the length of the lower molding flask in the direction of the height of the mold were greater than the length of the lower filling frame in the direction of the height of the mold, the lower surface of the lower mold that is molded would be above the lower surface of the lower molding flask. This is because the lower mold is attached to the lower filling frame when the mold is separated. That is, a lower mold would be produced that has a length in the direction of the height of the mold, which length is shorter than the length of the lower molding flask in the direction of the height of the mold.

Also, even if the lower surface of the lower mold that was molded were attached to the lower filling frame, the height of the part of the lower mold, which part contacts the lower molding frame, would be smaller, such that the mold cannot be separated in stable conditions. To avoid this problem the height of the mold should be made greater.

Namely, if the length of lower molding flask in the direction of the height the mold were greater than the length of the lower filling frame in the direction of the height of the mold, the lower mold that has the shorter height could not be molded or the lower mold that has the shorter length in the direction of the height of the mold would not be separated from the molding flasks in stable conditions.

Therefore, the height of the lower molding flask should be from 50 mm to 80 mm, more preferably from 60 mm to 70 mm. The height of the lower filling frame is preferably one that is equal to 1.5 times the desired height of the mold minus the height of the lower molding flask. So, for example, if the desired height of the mold is set as 100 mm, the total of the height of the lower molding flask and the height of the lower filling frame are preferably be 150 mm, and if the height of the lower molding flask is set as 60 mm, the height of the lower filling frame is preferably 90 mm. Also, if the desired height of the mold is set as 200 mm, the total of the height of the lower molding flask and the height of the lower filling frame is preferably 300 mm, and if the height of the lower molding flask is set as 70 mm, the height of the lower filling frame is preferably 230 mm.

EMBODIMENTS OF THE INVENTION

Figure 1:
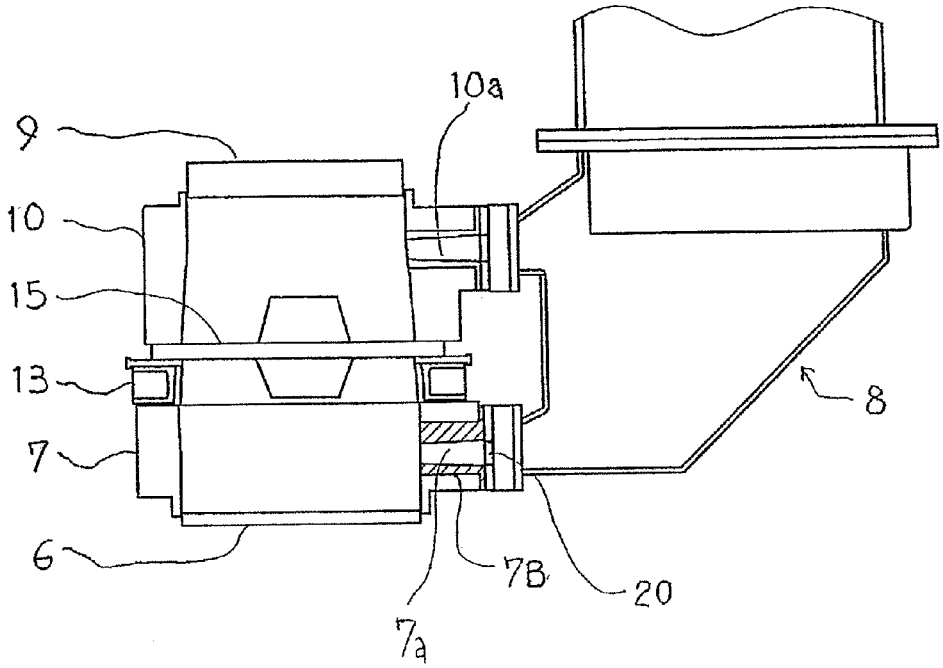
FIG. 1 is a first schematic illustration of the molding machine of the present invention, which includes the molds.

Below the best mode for carrying out the present invention is explained. The flaskless molding machine of the present invention has two molding flasks that have a matching plate 15 sandwiched between them, the two molding flasks being placed in a way such that one of the opening ends of each molding flask is opposed to each other and each of the other opening ends of the molding flasks is engaged with a squeezing board, whereby a pair of molding spaces is formed, into which spaces the molding sand is filled by air through each of the openings for introducing the molding sand, each of which opening is disposed on a wall of each of the two molding flasks that are opposed to each other, wherein the flaskless molding machine thus constituted produces two molds by squeezing the molding sand with the squeezing boards.

In the first embodiment, the flaskless molding machine comprises molding flasks consisting of an upper molding flask 10, a lower molding flask 13, and a lower filling frame 7, wherein the openings for introducing the molding sand are each disposed on the side walls of the upper molding flask 10 and the lower filling frame 7.

In the second embodiment, the flaskless molding machine comprises molding flasks consisting of an upper molding flask 10, an upper filling frame 23, and a lower molding flask 13, wherein the openings for introducing the molding sand are disposed on the side walls of the upper filling frame 23 and the lower molding flask 13.

In the third embodiment, the flaskless molding machine comprises molding flasks consisting of an upper molding flask 10, an upper filling frame 23, a lower molding flask 13, and a lower filling frame 7, wherein the openings for introducing the molding sand are disposed on the side walls of the upper filling frame 23 and the lower filling frame 7.

In the present invention, the term a "molding flask" refers to any one of the upper molding flask, the upper filling frame, the lower molding flask and the lower filling frame. The term a "matching plate" refers to the plate that has patterns on both surfaces of the pattern plate. The term a "squeezing board" refers to the upper squeezing board and the lower squeezing board. The term a "space to produce a mold" (molding space) refers to the space where a mold is formed. The term a "side wall of the molding flask" refers to the side wall of any of the upper molding flask, upper filling frame, lower molding flask, and lower filling frame. The term an "opening for introducing the molding sand" refers to the opening through which the molding sand is introduced into the molding flask.

The term "molding sand" refers to any sand suitable for use in molding. However, green sand that uses bentonite as a binder, for example, is preferred. The term "filling in molding sand by air" refers to the aeration, wherein the molding sand is filled into the molding flask by low-pressure air of from 0.05 to 0.18 MPa, or blow, wherein the molding sand is filled into the molding flask by high-pressure air of from 0.2 to 0.35 MPa.

The term an "upper molding flask" refers to the molding flask that is placed directly on a matching plate.

The term an "upper filling frame" refers to the molding flask that is connected to the upper end of the upper molding flask.

The term a "lower molding flask" refers to the molding flask that is directly connected to the lower surface of the matching plate.

The term a "lower filling frame" refers to the molding flask that is connected to the lower end of the lower molding flask.

The term a "member for introducing the molding sand" refers to a member for introducing the molding sand from the sand-tank. The term "changeable" means that the part or member in question is detachable or can be replaced by another part or member in any suitable way.

The wording "the member for introducing the molding sand can be fastened to the molding flask by changing the position of the opening for introducing the molding sand of the member for introducing the molding sand, relative to the parting plane can be changed depending on the direction of the member for introducing the molding sand that is to be attached" means that the member that introduces the molding sand is designed in a way such that (1) the center line for the width of the opening of the lower filling frame in the direction of the height of mold (into which opening the member for introducing the molding sand [nozzle] is inserted) and (2) the center line of the opening for introducing the molding sand (where the molding sand is introduced) of the member for introducing the molding sand (nozzle) in the direction of the height of mold do not match. Namely, the positions of the center line of the opening for introducing the molding sand (where the molding sand is introduced) of the member for introducing the molding sand are changeable, depending on the direction that the member for introducing the molding sand is fastened to the molding flask, i.e., depending on whether the member for introducing the molding sand is fastened to the molding flask in one direction or in the opposite direction (the opposite direction by 180 degrees).

The term a "tank that supplies the molding sand" (sand-tank) refers to a tank that can store the molding sand and that has openings for supplying the molding sand.

The wording "the lower molding flask has a matching plate attached and it can enter and exit the space formed midway between the upper molding flask and the lower filling frame" means that the matching plate is placed on top of the lower molding flask and fixed to it and that the lower molding flask and the matching plate thus formed can move as one body into the space formed midway between the upper molding flask and the lower filling frame.

The term "the lower filling frame can move up and down independently of and simultaneously with the lower squeezing board" means that the lower filling frame is moved up and down by a cylinder of the lower filling frame independently of the lower squeezing board and it also means that if the lower squeezing board is moved up and down by a cylinder for squeezing the flasks, the lower filling frame can move up and down with the lower squeezing board.

The cylinder for squeezing flasks of the present invention can be driven by an air-on oil. The driving by the air-on oil refers to the driving by means of a complex function of air-pressure and hydraulic fluid wherein the driving force of low-pressure air is converted to that of the hydraulic fluid. The air-on fluid system, which dispenses with a hydraulic pump, uses a booster cylinder that works on Pascal's principle, and also uses a source of the air pressure.

Example 1

Figure 4:
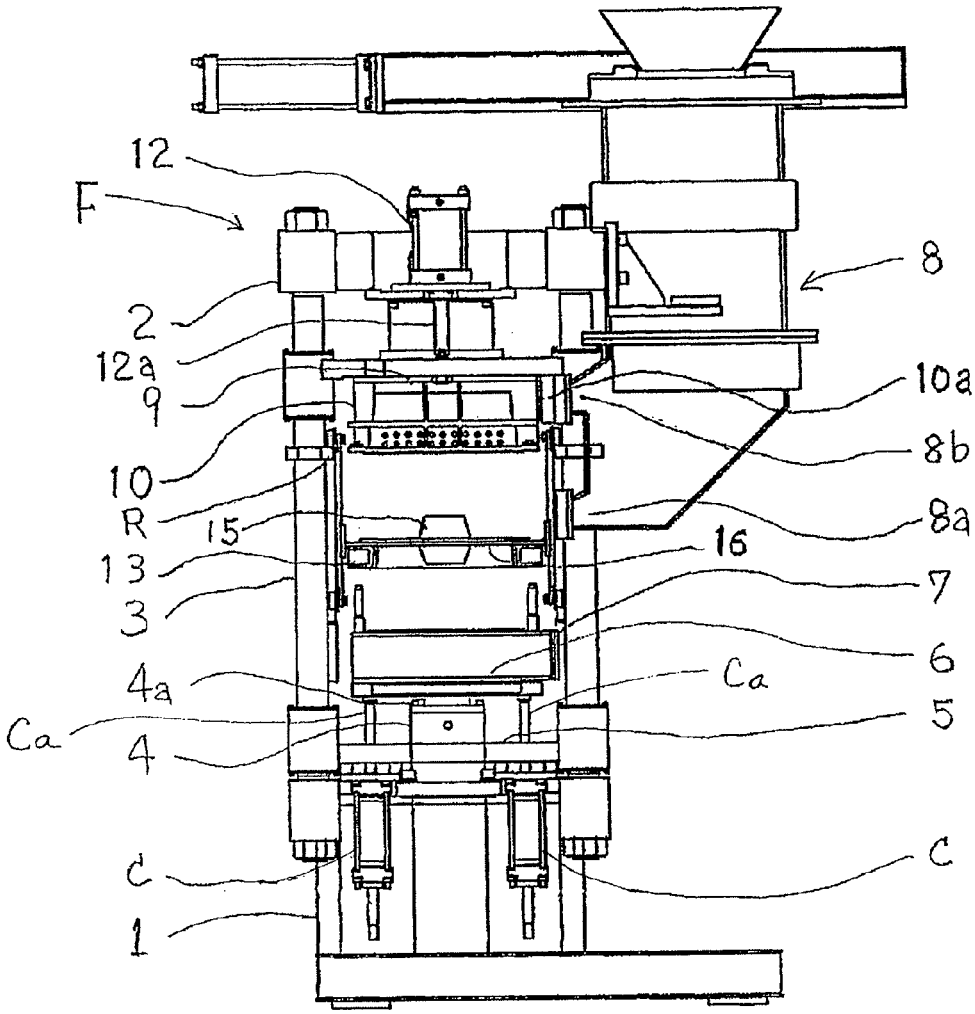
FIG. 4 is a schematic illustration of one embodiment of the molding machine of the present invention.

One embodiment of the flaskless molding machine of the present invention is explained by referring to the drawings. FIG. 4 is a schematic illustration of one embodiment of the molding machine of the present invention.

Figure 5:
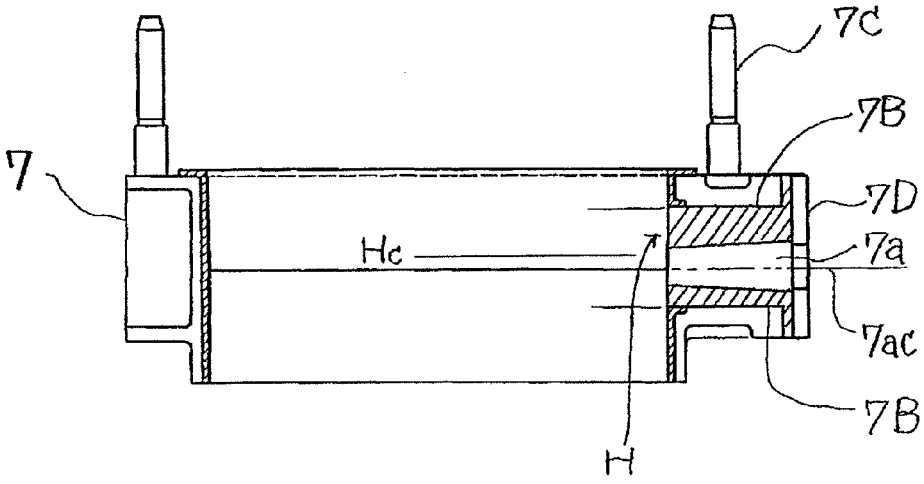
FIG. 5 is a schematic illustration of an enlarged cross section of a part of the area around the member for introducing molding sand.

FIG. 5 is a schematic illustration of an enlarged cross section of a part of the area around the member for introducing molding sand.

Figure 6:
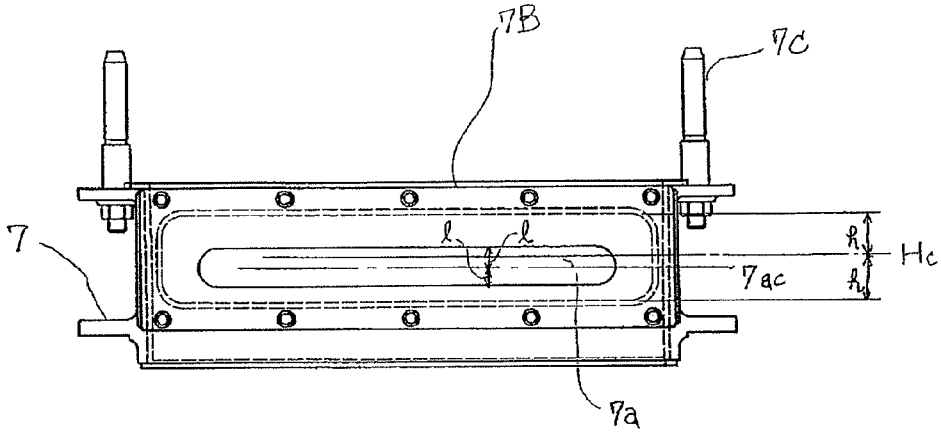
FIG. 6 is an enlarged side view of the area around the member for introducing molding sand.

FIG. 6 is an enlarged side view of the area around the member for introducing molding sand.

Figure 7:
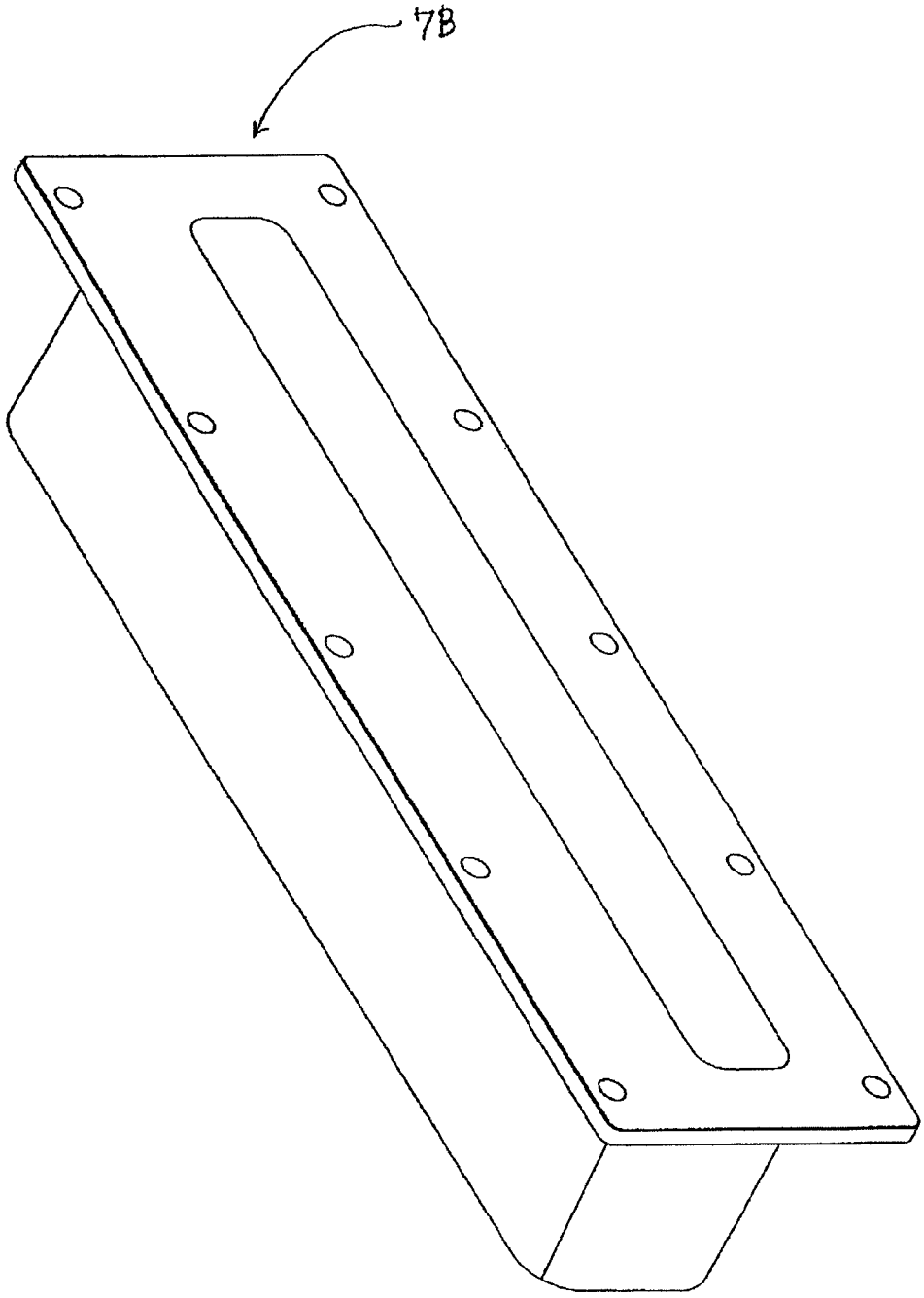
FIG. 7 is an enlarged perspective view of the member for introducing molding sand.

FIG. 7 is an enlarged perspective view of the member for introducing molding sand.

As shown in FIG. 4, an arch-type frame F is formed as one body wherein the frame comprises a lower base frame 1 connected with an upper frame 2 by columns 3, 3 disposed at the four corners of the lower base frame 1 and the upper frame 2. The cylinder for squeezing flasks 4 is installed upright at the center of the upper surface of the lower base frame 1. The lower squeezing board 6 is installed at the upper end of a piston rod 4*a* of the cylinder for squeezing flasks 4 via a lower squeezing frame 5.

Also, on the four corners of the lower base frame 1 are installed sliding bushes whereby the lower squeezing frame 5 can keep a horizontal position. On the outside of the cylinder for squeezing flasks 4 that is positioned at the center of the lower squeezing frame 5 are installed four cylinders for the lower filling frames C, C. The lower filling frame 7 is installed on each end of the piston rods of the cylinders for the lower filling frames. The lower squeezing frame 5 has, in its center, an opening for the cylinder for squeezing flasks 4, through which opening the main part of the cylinder for squeezing flasks 4 is inserted.

As shown in FIG. 5, the lower filling frame 7 has its inner side walls formed in a way that the distance between the walls gets narrower as they go downward, and has on its side wall the member for introducing the molding sand 7B, which member has an opening for introducing the molding sand 7*a*. Also, the lower filling frame 7 has an opening into which the lower squeezing board 6 enters while keeping a sealed contact. The member for introducing the molding sand 7B is changeable. As seen in FIG. 6, which shows an enlarged side view of the member for introducing the molding sand, the member for introducing the molding sand 7B comprises a main part and a flange so that it can be attached to the molding flask, even if the position of the member for introducing the molding sand is turned by 180 degrees. For this purpose, the flange has fastening holes at ten positions that are disposed symmetrically in the horizontal (and also vertical) direction. As such, the member for introducing the molding sand 7B can be installed in an inverted position. The position of the center of the opening for introducing the molding sand 7*a* can be changed relative to the opening of the parting plane, depending on the direction of the member for introducing the molding sand 7B (FIGS. 5 and 6).

Also, as seen in FIG. 4, the sand-tank 8 is fixed to the frame F and has bi-forked protrusions that each have an opening for supplying the molding sand 8*a*, 8*b*, at the ends, through which opening ends the molding sand is introduced. Also, the cylinders C, C, for lower filling frame and the cylinder for squeezing flasks 4 are provided as driving means whereby the opening for supplying the molding sand 8*a* of the sand-tank 8 is adjusted by moving the lower filling frame 7, so that it matches the opening for introducing the molding sand 7*a*.

The lower squeezing board 6 and the lower squeezing frame 5 are formed as one body, such that if the cylinder for squeezing flasks 4 moves up, the lower squeezing board 6 also moves up with the four cylinders C, C for lower filling frame, which cylinders are attached to the lower squeezing frame 5. Also, the lower filling frame 7 and the cylinders for lower filling frame C, C, are movable independently of, and also simultaneously with, the cylinder for squeezing flasks 4. Namely, the lower filling frame 7 is connected to the upper ends of the piston rods Ca of a plurality of cylinders for lower filling frame C, which cylinders are attached upright to the lower squeezing frame 5, where the lower squeezing frame 5 can move up and down sliding along the two or more columns 3, 3. A lower squeezing unit comprising the lower squeezing board 6 and the lower squeezing frame 5 can move up and down as one body. On the upper surface of the lower filling frame 7 positioning pins 7*c* are installed upright.

Opposite and above the lower squeezing board 6, an upper squeezing board 9 is fastened to the lower surface of the upper frame 2.

The upper molding flask 10 has an opening for introducing the molding sand 10*a* on its side wall, and its side walls are formed in a way such that the distance between the walls becomes wider as they go downward. Also, the upper molding flask 10 has a large opening into which the upper squeezing board 9 can enter while keeping a sealed contact. Also, a cylinder for upper molding flask 12 made up of an air-cylinder is fastened downward to the upper frame 2. The piston rod 12*a* is attached to the upper molding flask 10, and by the contracting movement of the piston rods 12*a* the cylinder moves the upper molding flask 10 upward.

In the space midway between the upper squeezing board 9 and the lower squeezing board 6 a space of an even width through which the lower molding flask 13 can pass is maintained. Rails R, each having a square shape, are laid piercing through the columns 3, 3, in the forward and backward direction. The matching plate 15, which has patterns on both its upper and lower surfaces, is attached to the upper surface of the lower molding flask 13 via the master plate 16.

The matching plate 15 is manufactured by the two pattern plates that have one pattern laid one on top of the other. The matching plate has a plate-like member that is formed by adjoining the back surfaces of the pattern plates.

Below we explain the operation of the flaskless molding machine of the present invention, described above. FIG. 4 shows a flaskless molding machine at its original position. In FIG. 4, the lower molding flask 13 that has a matching plate (pattern plate) 15 fastened on top of it, with a master plate 16 placed in between, enters between the lower squeezing board 6 and the upper squeezing board 9 along the rails R and then stops.

Next, by the upward movement of the cylinders for lower filling frame C and the cylinder for squeezing flasks 4, the lower filling frame 7 and lower squeezing board 6 move upward. Then the positioning pins 7*c* are inserted into the positioning holes of the lower molding flask 13, thereby having the lower filling frame 7 overlap the lower surface of the lower molding flask 13, and a closed space to produce a lower mold is formed by the lower squeezing board 6, the lower filling frame 7, the lower molding flask 13, and the matching plate 15. Then, these components are moved upward as one body, whereby the positioning pins 7*c* are inserted into the positioning holes of the upper molding flask 10. At the same time, by having the lower molding flask 13 overlap the lower surface of the upper molding flask 10, with the matching plate 15 and the master plate 16 placed in between, a closed space to produce an upper mold is formed by the upper squeezing board 9 being adjoined.

Thus with the space to produce an upper mold and the space to produce a lower mold formed, as shown in FIG. 1, the opening for introducing the molding sand 7*a* of the lower filling frame 7 is moved so that it matches the opening for supplying the molding sand 20 of the sand-tank 8.

For the sand-tank that supplies the molding sand, which sand-tank has a plurality of the openings for supplying the molding sand, to have the openings for introducing the molding sand 7*a* of the lower filling frame match the openings for supplying the molding sand of the sand-tank 8, the cylinder for squeezing flasks 4 is used as a means that moves at least one of the lower filling frame and the upper filling frame.

As seen in FIG. 6, if the matching plate has a thickness, for example, as great as 40 mm, the opening for introducing the molding sand 7*a* should be positioned at a relatively lower part of the lower filling frame 7 shown in FIG. 6. If the matching plate has a thickness as small as 8 mm, as shown in FIG. 6, the opening for introducing the molding sand 7*a* should be positioned at a relatively upper part of the lower filling frame 7 by having the member for introducing the molding sand being turned by 180 degrees. And as shown in FIG. 7, the member for introducing the molding sand 7B consists of a main body and a flange, where the flange has 10 fastening holes, which holes are symmetrically laid in the horizontal direction (and in the vertical direction). So, fixing the member for introducing the molding sand can be easily carried out.

As seen in FIGS. 5 and 6, (1) the center line Hc for the width of the opening H (the part of the lower filling frame 7 where the member for introducing the molding sand 7B (nozzle) is inserted) of the lower filling frame 7 in the direction of the height of the mold, and (2) the center line lac for the width of the opening for introducing the molding sand 7*a* of the member for introducing the molding sand 7B (the part of the member for introducing the molding sand 7B where the molding sand passes) in the direction of the height of the mold do not match. So, even if the positions at which the cylinder for squeezing flasks 4 stops vary, depending on the thickness of the matching plate, the opening for introducing the molding sand 7*a* and the opening for supplying the molding sand 20 of the sand-tank 8 match, such that producing the mold can be smoothly carried out.

Thus the flaskless molding machine of the present invention can produce a mold when a matching plate that simultaneously molds both upper and lower molds is used. It can also produce a mold whether a pattern plate that is reused as a matching plate has a thin or thick wall. So, the flaskless molding machine of the present invention has the advantage that it does not need any additional component and thus has a simple structure.

If the thickness of the matching plate is greater than 40 mm, the member for introducing the molding sand 7B, if turned by 180 degrees, cannot be used because of the size of the member for introducing the molding sand relative to the size of the molding flask. If the thickness of the matching plate is less than 8 mm, the member for introducing the molding sand 7B, if turned 180 degrees, cannot be used because of the size of the member for introducing the molding sand relative to the size of the molding flask.

In the above embodiments, matching plates that have from a relatively small to medium thickness, such as from 8 mm to 40 mm are described. However, on a few occasions, all the matching plates are, for example, from 38 mm to 70 mm thick. In such cases, a sand-tank 8 should be designed so that the opening for supplying the molding sand 20 of the sand-tank 8 has its center line coincide with the center line lac of the opening for introducing the molding sand 7*a* of the member for introducing the molding sand 7B. In any event, the flaskless molding machine of the present invention can use one and the same sand-tank, if the matching plate is 32 mm thick or less.

If compressed air is introduced into the sand-tank 8 after the sand-gate is closed, the molding sand in the sand-tank 8 is supplied to the upper part of the closed space to produce an upper mold and the lower part of the closed lower space to produce a lower mold through the opening for introducing the molding sand 10*a* of the upper molding flask 10 and through the opening for introducing the molding sand 7*a* of the lower filling frame 7, respectively. At the same time only the pressurized air is exhausted through the exhaust ports (not shown) of the side walls of the upper molding flask 10 and the lower molding flask 13.

Then while the lower filling frame 7, the lower molding flask 13, the matching plate 15, and the upper molding flask 10 are moved upward by the extension of the cylinder for squeezing flasks 4, the molding sand in the closed space to produce an upper mold and the closed space to produce a lower mold are both squeezed by the upper squeezing board 9 and the lower squeezing board 6.

After completion of the squeezing, the lower squeezing board 6 is lowered by the contraction of the cylinder for squeezing flasks 4, while the lower molding flask 13, the matching plate 15 and the master plate 16 are left on the rails R. However, after separation from the pattern of the matching plate 15 and the lower molding flask 13, the lower mold is lowered with the lower filling frame 7.

Then the cylinder for squeezing flasks 4 is lowered to the original position by a contracting movement and then stops. The lower filling frame 7 is kept at the position where the squeezing operation completes, while only the lower squeezing board 6 is lowered to its original position by the cylinder for squeezing flasks 4 being lowered to its lowest position.

Next, when the lower molding flask 13, the matching plate 15 and the master plate 16 exit from the molding position, then, the spaces to produce molds are ready to receive cores. But placing the cores is not always required.

When, depending on the requirements, inserting the core is completed, the cylinder for squeezing flasks 4 restarts the extension movement and moves the lower squeezing board 6 upward. Then the lower mold contacts the upper mold. While keeping this position the upper mold 10 is separated from the upper molding flask 10 by the cylinder for the upper flask 12 being moved upward.

After the upper mold is separated from the upper molding flask 10, the lower squeezing board 6 is lowered by the downward movement of the cylinder for squeezing flasks 4. When the cylinder C for the lower filling frame contracts, the lower mold is separated from the lower filling frame and is ready to be transferred. The upper and lower molds on the lower squeezing board 6 are forwarded to the transportation line by the plate for pushing the mold (not shown).

As clearly seen from the above explanation, in the present embodiment, (1) the center line Hc for the width of the opening H (the part of the lower filling frame 7 where the member for introducing the molding sand 7B (nozzle) is inserted) of the lower filling frame 7 in the direction of the height of the mold, and (2) the center line lac for the width of the opening for introducing the molding sand 7*a* of the member for introducing the molding sand 7B (the part of the member for introducing the molding sand 7B where the molding sand passes) in the direction of the height of the mold do not match.

So, even if the positions where the cylinder for squeezing flasks 4 stops and vary, depending on the thickness of the matching plate, the opening for introducing the molding sand 7*a* and the opening for supplying the molding sand 20 of the sand-tank 8 match, such that producing the molds can be smoothly carried out.

In the present embodiment, the matching plate had a plate-like member that is formed by the back surfaces of the two pattern plates put together, one prepared specifically for an upper molding flask having a pattern only on one surface and the other prepared specifically for a lower molding flask.

But the matching plate that is manufactured to simultaneously produce the upper and the lower molds, and that has patterns on both upper and lower surfaces of the plate-like member, can be used.

Also, in the present embodiment, "aeration" is used for introducing the molding sand from the sand-tank. But "blowing" can also be used. In the present invention, the aeration means introducing the molding sand by the compressed air of low-pressure of from 0.05 to 0.18 MPa. Blowing means introducing the molding sand by the compressed air of high-pressure of from 0.2 to 0.35 MPa.

So as to enable a smooth change of the wear parts for the member for introducing the molding sand 7B, the member for introducing the molding sand 7B is preferably made up of the main body of the member for introducing the molding sand 7B (the member for introducing the molding sand 7B consists of a main body and a flange) and wear parts 7D that are used for the side surfaces. The member for introducing the molding sand 7B of this structure enables an easy maintenance.

Example 2

Figure 2:
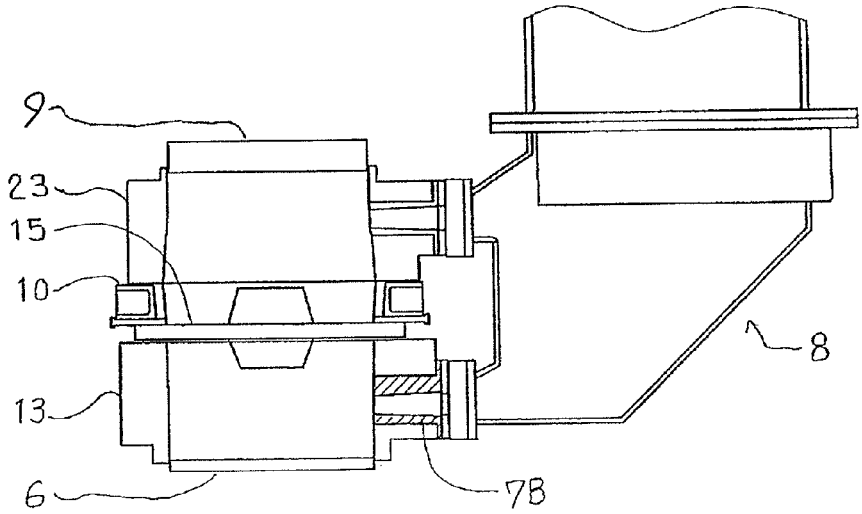
FIG. 2 is a second schematic illustration of the molding machine of the present invention, which includes the molds.

In Example 2, the flaskless molding machine in the embodiment as shown in FIG. 2 is explained. The flaskless molding machine in this embodiment uses a matching plate 15 and an upper molding flask 10. Also, the upper molding flask 10 and the matching plate 15 are constituted in a way that they move as one body. Further, it has a large lower molding flask 13, to which is attached the member for introducing molding sand 7B that is changeable. The other constructions and the movements are the same as those given in Example 1. So, any further reference to them is omitted

Example 3

Figure 3:
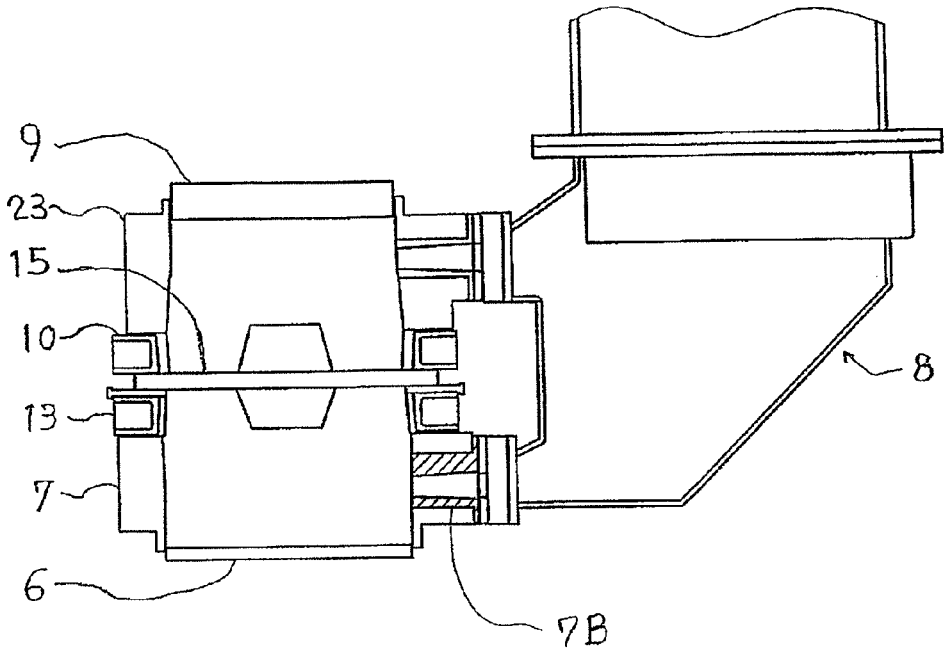
FIG. 3 is a third schematic illustration of the molding machine of the present invention, which includes the molds.

In Example 3, the flaskless molding machine in the embodiment shown in FIG. 3 is explained. The flaskless molding machine in this embodiment uses a matching plate 15 and an upper molding flask 10 and an upper filling frame 23. Also, the lower molding flask 13 and the matching plate 15 are constituted in a way that they move as one body. Further the flaskless molding machine in the embodiment uses the lower molding flask 13 and the lower filling frame 7. The member for introducing the molding sand 7B, which is changeable, is attached to the lower filling frame 7. The other constructions and their movements are the same as those given in Example 1. So, any further reference to them is omitted In the above Examples, the opening for introducing the molding sand 7*a* is designed so that it is positioned horizontally. However, the opening for introducing the molding sand 7*a* itself can be inclined either upward or downward. Likewise, the opening for introducing the molding sand 10*a* itself can be inclined upward or downward.

The above Examples are described merely for the purpose of illustrating the embodiments of the present invention. It is recognized that the present inventions are not limited to those embodiments because persons skilled in the art can readily modify the inventions described in the Examples without departing from the scope and the spirit of the inventions.

The present application is based on the Japanese Patent Applications, No. 2010-006368, filed Jan. 15, 2010, which is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skills in the art on the basis of the detailed description.

The applicant has no intention of dedicating to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

SYMBOLS

2 upper frame
3 column
5 lower squeezing frame
6 lower squeezing board
7 lower filling frame
7*a* opening for introducing the molding sand
7B member for introducing the molding sand
8 tank that supplies the molding sand
9 upper squeezing board
10 upper molding flask
13 lower molding flask
15 matching plate
C cylinder for the lower filling frame

The invention claimed is:

1. A flaskless molding machine comprising:

two molding flasks that have a matching plate sandwiched between them, the two molding flasks, each having two opening ends, being positioned in a way that one of opening ends of the molding flasks is opposed to each other and each of the other opening ends of the molding flasks is engaged with a squeezing board, whereby a pair of spaces is formed, each space being a space to produce a mold (molding space), into which spaces molding sand is filled by air through each of openings for introducing the molding sand, disposed on a wall of each of the two molding flasks that are opposed to each other, as described above, the flaskless molding machine thus constituted molding two molds by squeezing the molding sand with the squeezing boards, wherein the molding flasks consist of an upper molding flask, an upper filling frame, a lower molding flask, and a lower filling frame, and wherein the openings for introducing the molding sand are disposed on side walls of the upper filling frame and the lower filling frame, and wherein at least one of the upper filling frame and the lower filling frame has a member for introducing the molding sand, the member having an opening for introducing the molding sand and being changeable wherein a position of the opening for introducing the molding sand of the member for introducing the molding sand relative to a parting plane can be changed, depending on a direction in which the member for introducing the molding sand is fixed.

2. The flaskless molding machine of claim 1, wherein the flaskless molding machine comprises:

(1) a sand-tank that supplies molding sand into each of a pair of spaces, each space being the space to produce a mold, the sand-tank of which position is fixed and which has bi-forked protrusions that each have an opening for supplying the molding sand at the ends; and (2) a driving means that moves at least one of the lower filling frame or the upper filling frame so as to have the openings for introducing the molding sand of the members for introducing the molding sand match the openings for supplying the molding sand of the sand-tank.

3. The flaskless molding machine of claim 1, wherein the matching plate have a plate-like member that is formed by the back surfaces of the two pattern plates put together, one prepared specifically for an upper molding flask having a pattern only on one surface and the other prepared specifically for an lower molding flask having a pattern only on one surface.

4. The flaskless molding machine of claim 1, wherein the matching plate that is manufactured to simultaneously produce the upper and the lower molds and that has patterns on both the upper and lower surfaces of a plate-like member.

5. The flaskless molding machine of claim 4, wherein the squeezing boards comprise a lower squeezing board that moves up and down and an upper squeezing board that is fixed at a position that is above and opposed to the lower squeezing board.

6. The flaskless molding machine of claim 1, wherein the length of the lower filling frame in the direction of the height of the mold is greater than the length of the lower molding flask in the direction of the height of the mold.

7. The flaskless molding machine of claim 3, wherein the thickness of the matching plate is 32 mm or less.

8. The flaskless molding machine of claim 4, wherein the thickness of the matching plate is 32 mm or less.

9. The flaskless molding machine of claim 1, wherein the height of the lower molding flask in the direction of the height of the mold is from 50 mm to 80 mm.

* * * * *